US008072411B2

(12) United States Patent
Chen et al.

(10) Patent No.: US 8,072,411 B2
(45) Date of Patent: Dec. 6, 2011

(54) GATE LINE DRIVING CIRCUIT OF LCD PANEL

(75) Inventors: Yan-Jou Chen, Zhongli (TW); Hung-Jen Wang, Xinzhuang (TW)

(73) Assignee: Hannstar Display Corp., Taipei (TW)

( * ) Notice: Subject to any disclaimer, the term of this patent is extended or adjusted under 35 U.S.C. 154(b) by 375 days.

(21) Appl. No.: 12/501,518

(22) Filed: Jul. 13, 2009

(65) Prior Publication Data

US 2010/0013804 A1 Jan. 21, 2010

(30) Foreign Application Priority Data

Jul. 18, 2008 (TW) ..... 97127488 A

(51) Int. Cl.
*G09G 3/36* (2006.01)

(52) U.S. Cl. ..... 345/100

(58) Field of Classification Search ..... 345/87, 345/92, 98, 99, 100, 204, 211, 212, 213; 327/333; 326/80; 377/64
See application file for complete search history.

(56) References Cited

U.S. PATENT DOCUMENTS 7,602,368 B2 * 10/2009 Chen et al. ..... 345/100
7,796,106 B2 * 9/2010 Ha ..... 345/88

* cited by examiner

*Primary Examiner* — Abbas Abdulselam
(74) *Attorney, Agent, or Firm* — Ming Chow; Sinorica, LLC

(57) ABSTRACT

A gate line driving circuit comprises a driving chip comprising first and second output ports, a LCD panel comprising first, second and third gate lines, a first switch and a second switch. Two terminals of the first gate line are respectively connected to the first output port and the control terminal of the first switch. Two terminals of the third gate line are respectively connected to the second output port and the control terminal of the second switch. The input terminal of the first switch electrically connects an operating voltage and the output terminal of the first switch electrically connects to the input terminal of the second switch. The output terminal of the second switch electrically connects a ground point, and one terminal of the second gate line is connected to between the output terminal of the first switch and the input terminal of the second switch.

7 Claims, 13 Drawing Sheets

GATE LINE DRIVING CIRCUIT OF LCD PANEL

BACKGROUND OF THE INVENTION

1. Field of the Invention

The present invention relates to a LCD panel driving circuit, and particularly to a gate line driving circuit of the LCD panel.

2. Description of the Related Art

At present, a liquid crystal panel is popular due to its advantages of low power consumption, low radiation. Driving of the LCD is achieved by using a TFT (thin-film transistor) circuit to control the rotating angles of liquid crystal molecules inside the liquid crystal panel so as to display various pictures. In detail, the TFT circuit comprises a plurality of parallel gate lines, or called scan lines, and a plurality of parallel data lines, or called signal lines. The gate lines and the data lines are disposed orthogonally across with each other to form a matrix control circuit. While refreshing a frame, the gate lines are triggered one by one, that is, feeding a high voltage level and then receiving signals from the data lines orthogonally across with one of the gate lines so as to refresh a plurality of corresponding pixels coupling to the gate line. Therefore, the trigger signals of the gate lines are interlaced in order to control the signals of the pixels each.

Refer to FIG. 1 for the schematic view of a LCD panel driving circuit according to the prior art. As shown in the figure, a driving chip 10 comprises a plurality of output ports, such as a first output port 11, a second output port 12 and a third output port 13. The LCD panel 20 comprises a plurality of gate lines, such as a first gate line 21, a second gate line 22 and a third gate line 23. In addition, the LCD panel 20 further comprises a plurality of data lines which are disposed orthogonally across with the gate lines. However, the data lines are not shown in the figure since they have no direct relationship with the present invention. In the prior art, each gate line is electrically connected to an output port respectively. As shown in FIG. 1, the first output port 11 is electrically connected to the first gate line 21, the second output port 12 is electrically connected to the second gate line 22 and the third output port 13 electrically connected to the third gate line 23. Please also refer to FIG. 2 for a signal waveform chart of the LCD panel driving signals according to the prior art. In the prior art, the driving chip 10 sequentially outputs the trigger voltages from each output port to each gate line. Therefore, the driving signal of the first gate line is logical high in the first period T1, the driving signal of the second gate line is logical high in the second period T2, and the driving signal of the third gate line is logical high in the third period T3.

However, since a LCD panel needs hundreds of gate lines, and even one driving chip is able to provide dozens of output ports, the LCD panel still needs dozens of driving chips to satisfy the trigger mode mentioned above, so as to achieve fast refresh of the frames thereby maintaining the fluency of the pictures.

In view of the drawbacks of the prior art, the inventor of the present invention, based on years of experience in the related industry, has conducted extensive researches and experiments, and finally developed a gate line driving circuit of a LCD panel in accordance with the present invention to overcome the aforementioned drawbacks.

SUMMARY OF THE INVENTION

Accordingly, one objective of the present invention is to provide a gate line driving circuit of LCD panel for reducing the numbers of driving chips needed in a LCD panel.

According to the objective of the present invention, a gate line driving circuit is provided, which comprises a driving chip which at least comprising a first output port and a second output port, a LCD panel which at least comprising a first gate line, a second gate line and a third gate line, a first switch and a second switch. Wherein, one terminal of the first gate line is electrically connected to the first output port, the other terminal of the first gate line is electrically connected to the control terminal of the first switch. One terminal of the third gate line is electrically connected to the second output port, and the other terminal of the third gate line is electrically connected to the control terminal of the second switch. The input terminal of the first switch is electrically connected to an operating voltage. The output terminal of the first switch is electrically connected to the input terminal of the second switch. The output terminal of the second switch is electrically connected to a ground point. One terminal of the second gate line is electrically connected to between the output terminal of the first switch and the input terminal of the second switch.

Besides, the gate line driving circuit of the invention further comprises a high level stabilizing circuit and a low level stabilizing circuit for increasing the stability of the driving signal of the second gate line of the present invention. Wherein, the high level stabilizing circuit is for stabilizing the logical high signal in the second gate line. And, the low level stabilizing circuit is for stabilizing the logical low signal in the second gate line.

As mentioned above, the gate line driving circuit of the LCD panel of the present invention may comprise the following advantages:

(1) The gate line driving circuit of the LCD panel is able to use two ports to drive three gate lines, and also can use three ports to drive five gate lines. In other words, the gate line driving circuit of the LCD panel is able to use half the number of output ports comparing with the prior art to achieve the same performance. Therefore, the gate line driving circuit of the LCD panel saves a half of driving chips.

(2) The gate line driving circuit of the LCD panel needs more TFT, but since the TFT are able to be implemented easily by modifying the photo mask to be used in the process of manufacturing, there would be minimum cost increase.

BRIEF DESCRIPTION OF THE DRAWINGS

The following is a detailed description of preferred embodiments of the present invention with reference to the accompanying drawings.

In the Figures.

DETAILED DESCRIPTION OF THE PREFERRED EMBODIMENTS

Figure 1:
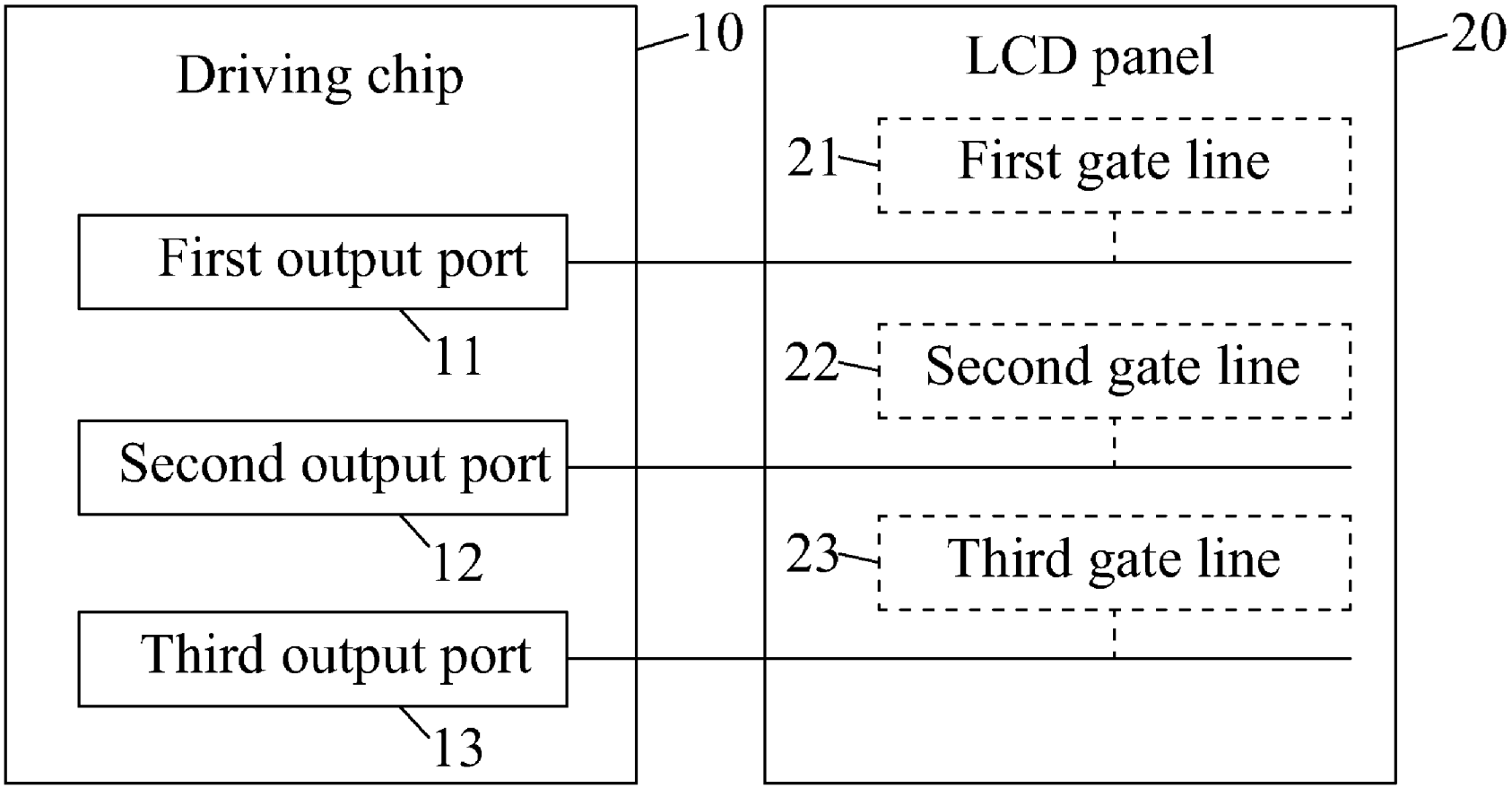
FIG.1 (Prior Art)
FIG. 1 is a schematic view of a LCD panel driving circuit of a prior art.
Figure 2:
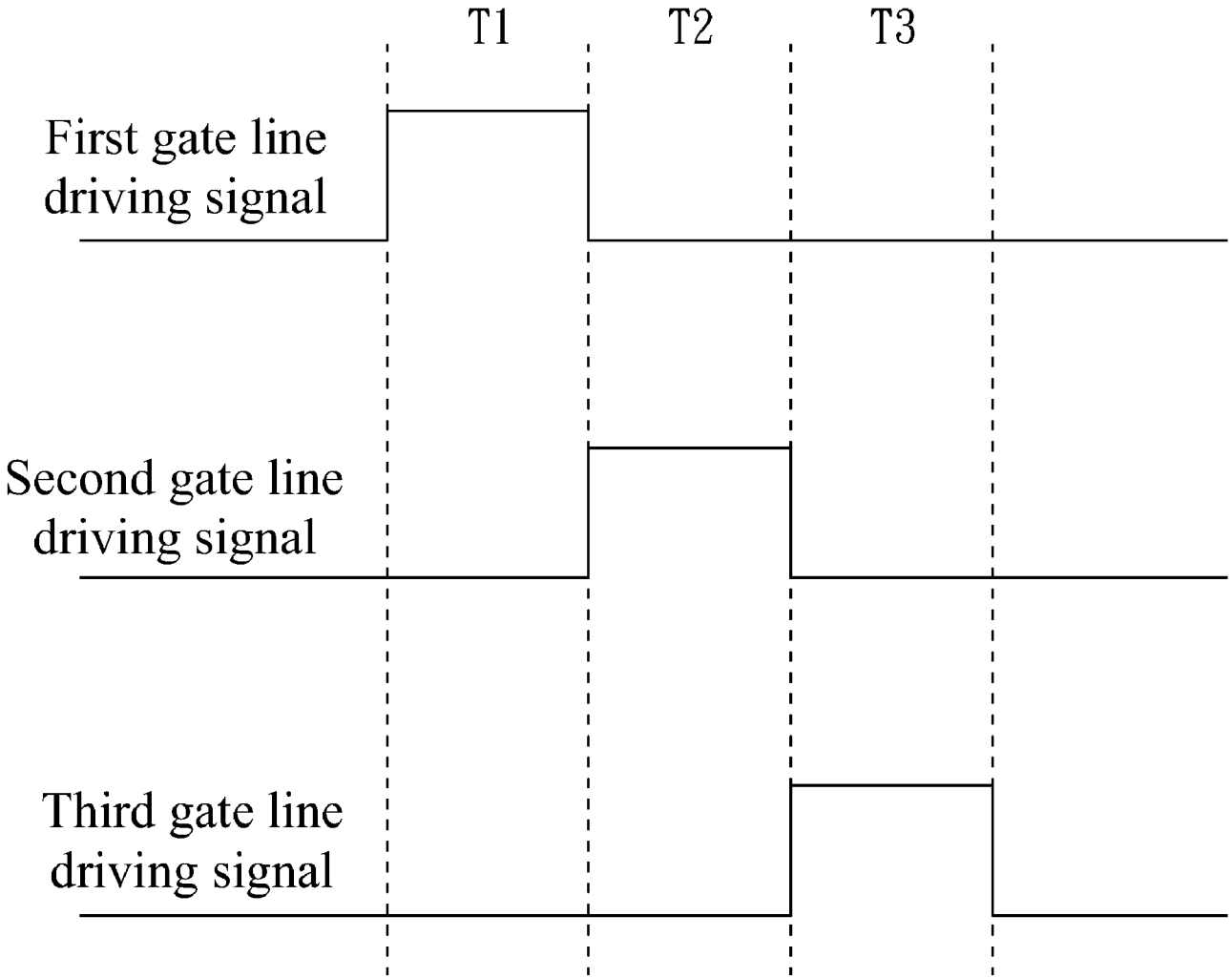
FIG.2(Prior Art)
FIG. 2 is a signal waveform chart of a LCD panel driving signal of the prior art.
Figure 3:
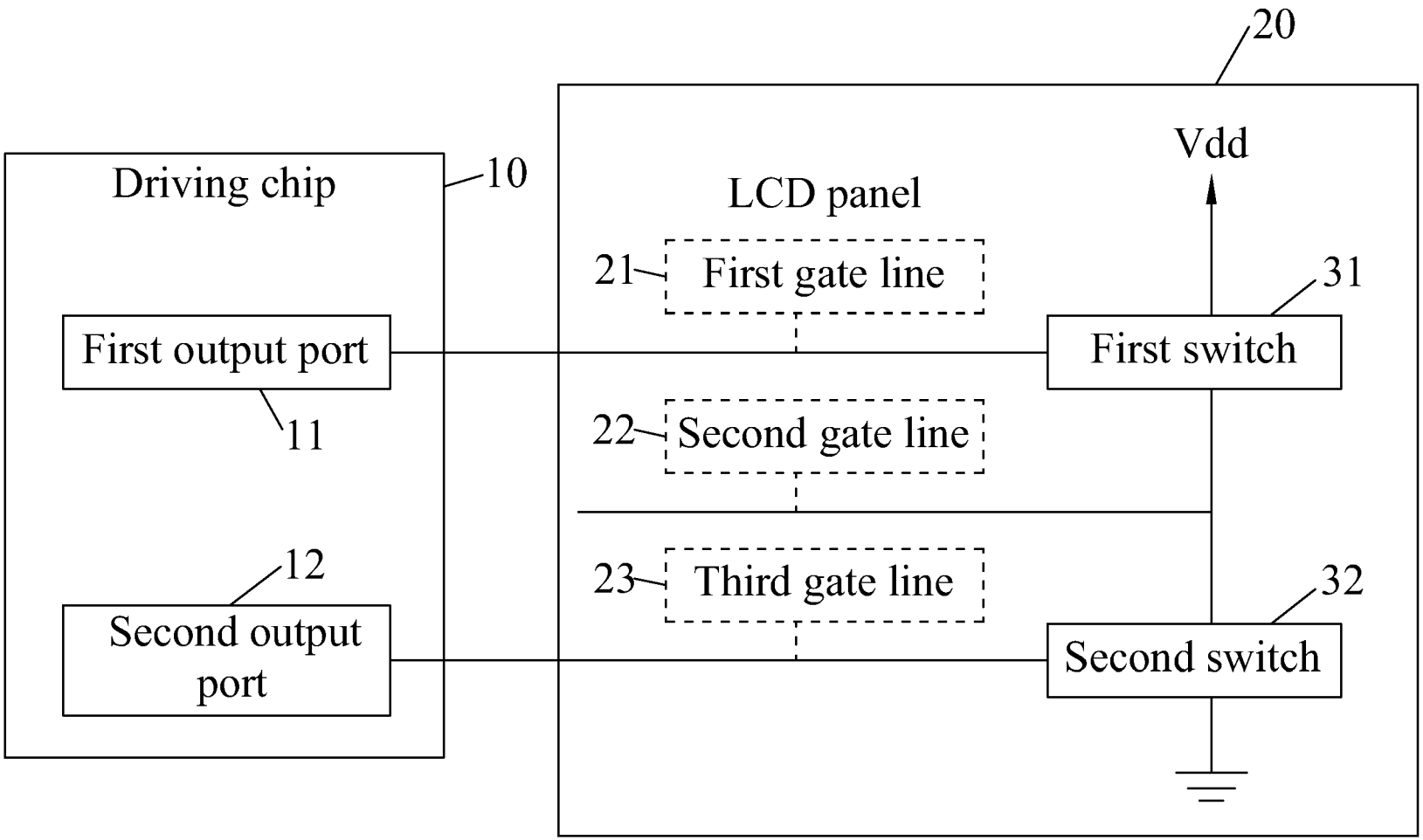
FIG. 3 is a schematic view of a gate line driving circuit of the present invention.

Please refer to FIG. 3 for a schematic view of a gate line driving circuit in accordance with the present invention. The gate line driving circuit comprises a driving chip 10, a LCD panel 20, a first switch 31 and a second switch 32. The driving chip 10 at least comprises a first output port 11 and a second output port 12. The LCD panel 20 at least comprises a first gate line 21, a second gate line 22 and a third gate line 23. One terminal of the first gate line 21 is electrically connected to the first output port 11, and the other terminal of the first gate line 21 is electrically connected to the control terminal of the first switch 31. One terminal of the third gate line 23 is electrically connected to the second output port 12, and the other terminal of the third gate line 23 is electrically connected to the control terminal of the second switch 32. The input terminal of the first switch 31 is electrically connected to an operating voltage Vdd. The output terminal of the first switch 31 is electrically connected to the input terminal of the second switch 32. The output terminal of the second switch 32 is electrically connected to a ground point. One terminal of the second gate line 22 is electrically connected to between the output terminal of the first switch 31 and the input terminal of the second switch 32.

Figure 4:
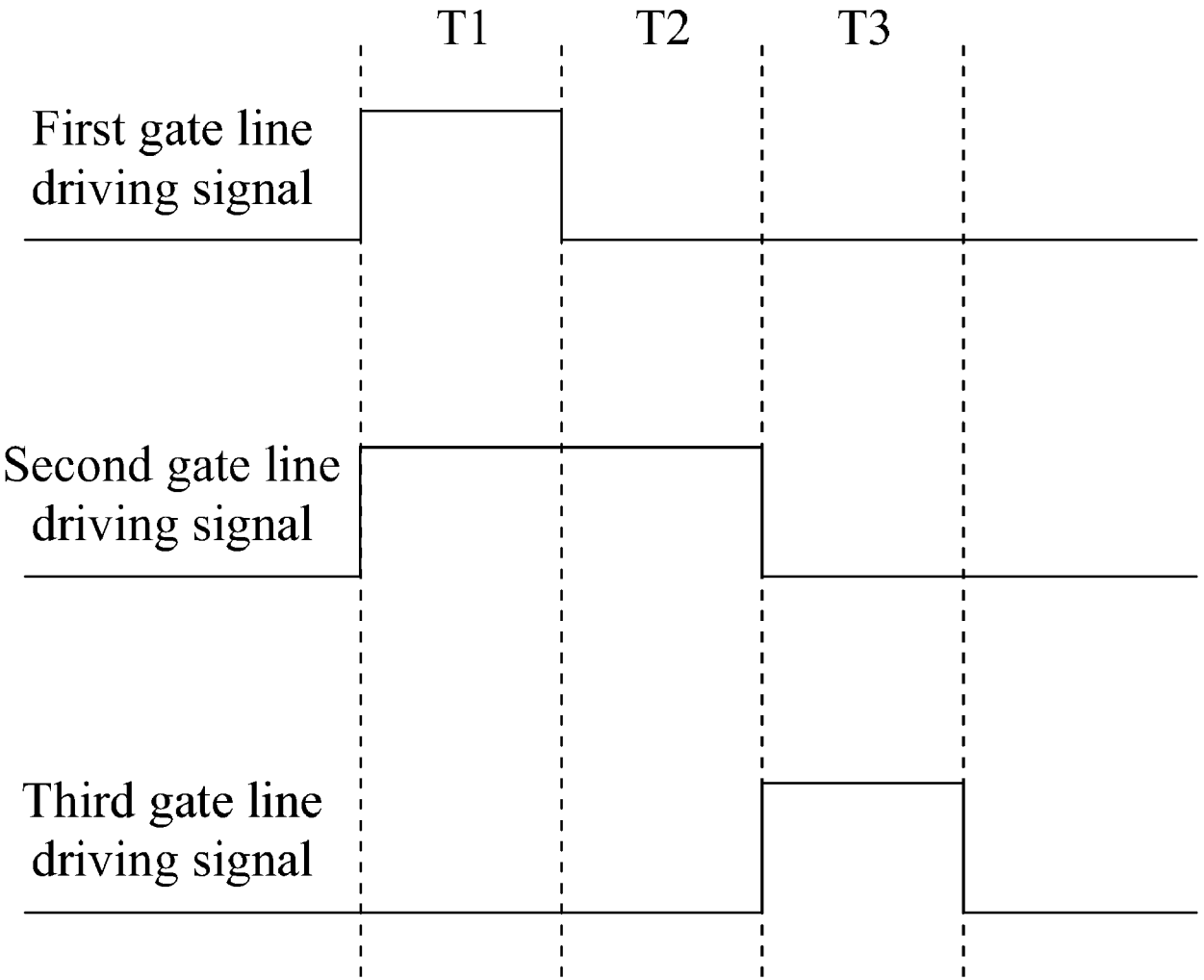
FIG. 4 is a signal waveform chart of a gate line driving signal of the present invention.

Please refer to FIG. 4 for a signal waveform chart of a gate line driving signal in accordance with the present invention. When the first output port 11 outputs a trigger voltage to the first gate line 21 in a first period T1, the driving signal of the first gate line 21 is logical high. In the meanwhile, the first switch 31 receives the driving signal which is logical high from the first gate line 21, and the driving signal turns on the first switch 31. Therefore, one terminal of the second gate line 22 electrically connects the operating voltage Vdd. Besides, since the second output port 12 only provides a logical low signal to the third gate line 23, the second switch 32 is turned off. In conclusion, the driving signals of the first gate line 21 and the second gate line 22 are both logical high in the first period T1. When it comes to a second period T2, the first output port 11 provides a logical low signal to the first gate line 21 and causes the first switch 31 to be turned off. Since the second switch 32 is still turned off, the driving signal of the second gate line 22 remains logical high in the second period T2. When it comes to a third period T3, the second output port 12 provides a trigger signal to the third gate line 23 and therefore the driving signal of the third gate line 23 is logical high. In the meanwhile, the second switch 32 receives the logical high signal from the third gate line 23, and therefore is turned on. Since the second switch 32 is turned on, one terminal of the second gate line 22 connects the ground point to receive the ground voltage. Therefore, the present invention uses the first switch 31 and the second switch 32 to make the driving signal of the second gate line 22 be logical high in the second period T2, and further make the driving signal of the second gate line 22 be logical low in the third period T3.

Figure 5:
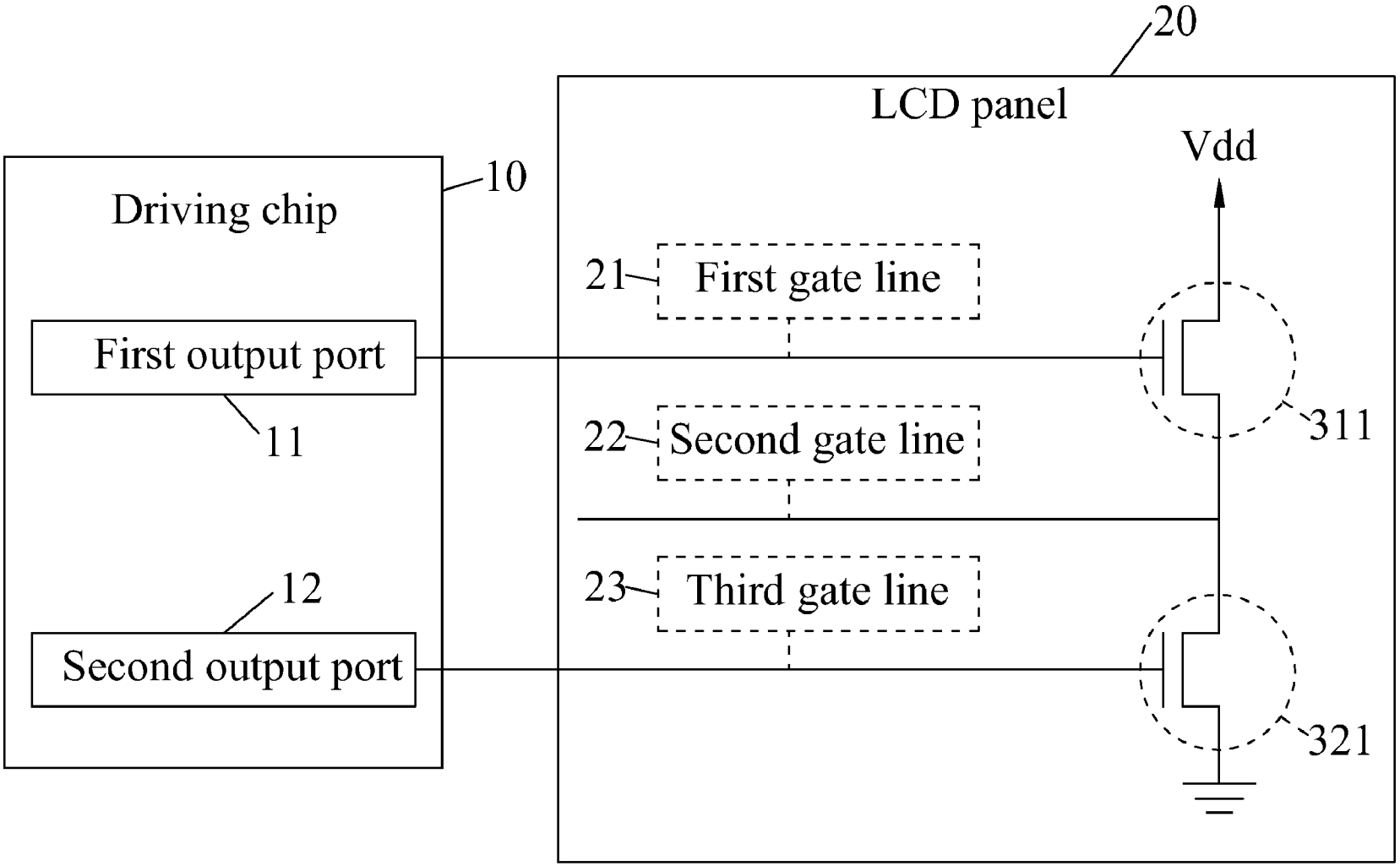
FIG. 5 is a schematic view of a gate line driving circuit of an embodiment of the present invention.

Please refer to FIG. 5 for a schematic view of a gate line driving circuit of an embodiment of the invention. Wherein, a first switch 311 is preferably a transistor switch. For matching a common LCD driving circuit process, the transistor switch 311 may be a field effect transistor (FET) switch, and particularly be a TFT switch. By this means, the transistor switch 311 is able to be implemented by merely modifying the photo mask without increasing any cost. Besides, since the transistor switch 311 is merely a switch, there is no difference between the composition of source terminal and the composition of drain terminal. With the same reason, a second switch 321 may also be a transistor switch.

As the aforementioned, the drawback of the gate line driving circuit of the LCD panel of the present invention is that pixels corresponding to the second gate line 22 might be coupled with error signals while the first gate line 21 triggers the data lines to refresh pixels corresponding to the first gate line 21 in the first period T1, and the errors are not corrected until the second period T2. However, since the refresh rate of the LCD panel is very high, it might not be noticed by the naked eyes, the drawback may be ignored. On the other hand, the present invention is able to save almost half of the output ports for the gate line driving circuit driving the hundreds of gate lines of a whole LCD panel 20. That is, the gate line driving circuit of the LCD panel of the present invention only needs a half of driving chips 10 to achieve the same effect of the prior art.

Figure 6:
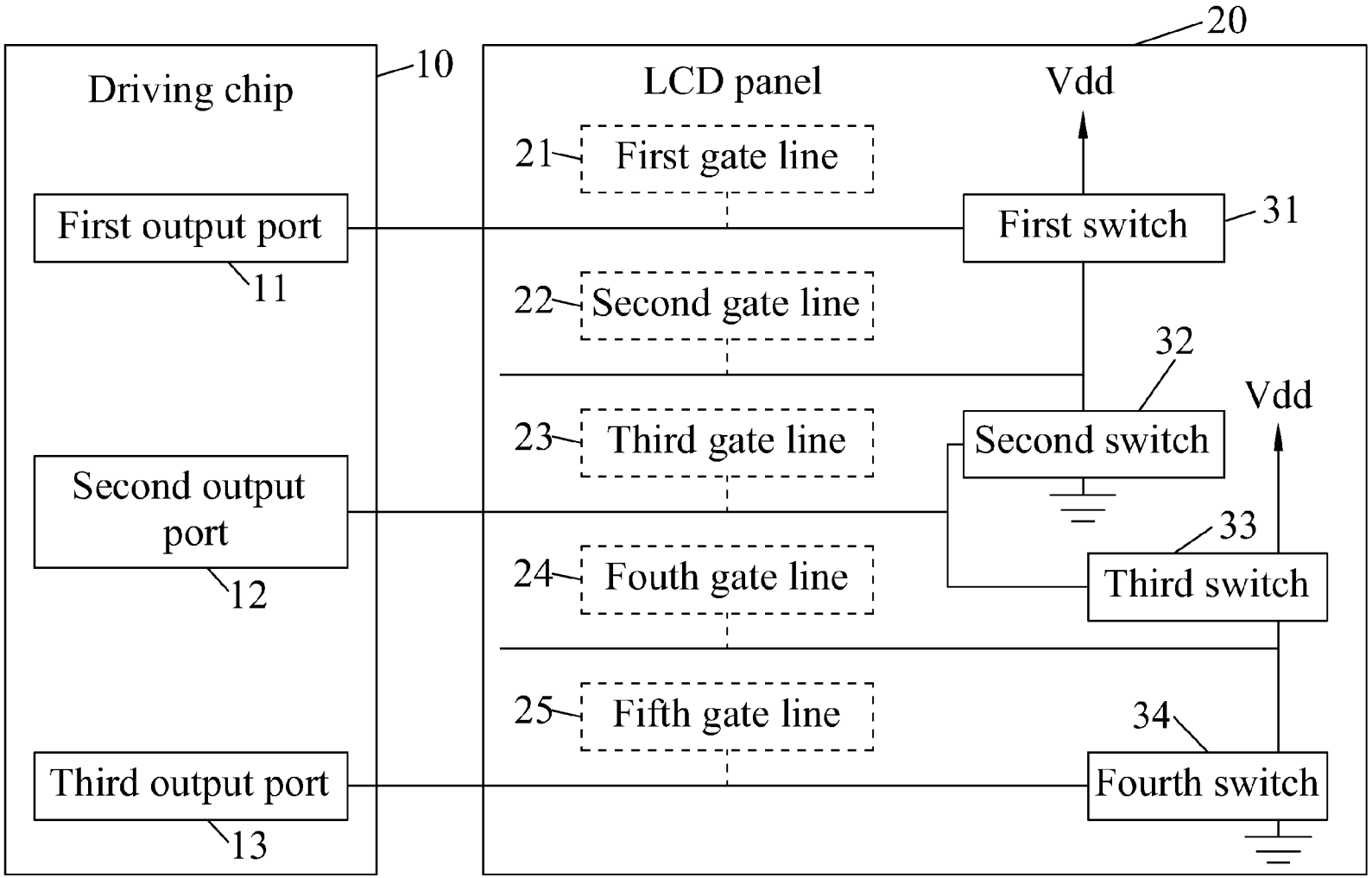
FIG. 6 is a schematic view of a gate line driving circuit of another embodiment of the present invention.
Figure 7:
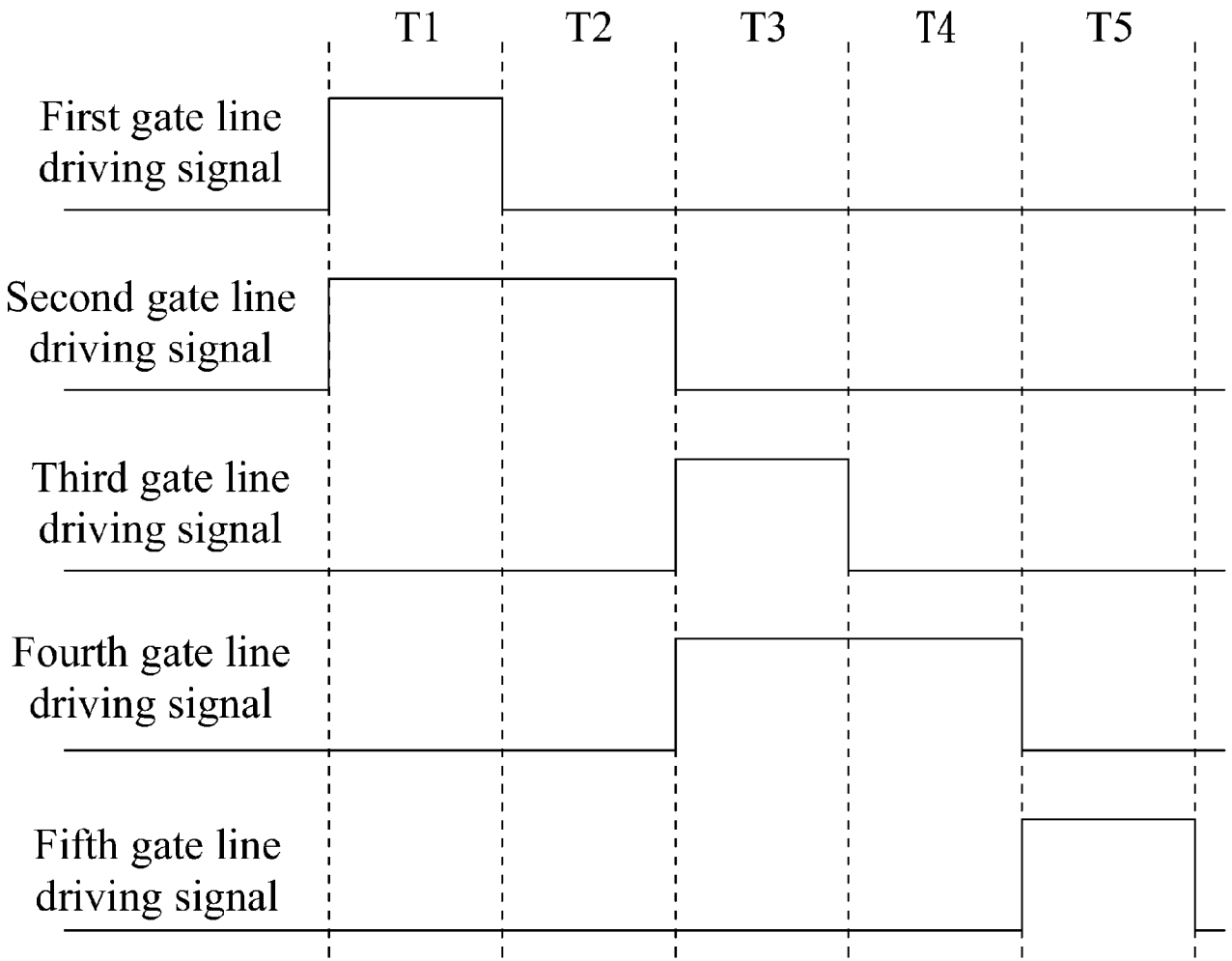
FIG. 7 is a signal waveform chart of a gate line driving signal of an embodiment of the present invention.

Please refer to FIG. 6, which shows a schematic view of a gate line driving circuit of another embodiment of the present invention. In the figure, the way that a first output port 11 and a second output port 12 drive a first gate line 21 and a third gate line 23, and control a second gate line 22 by using a first switch 31 and a second switch 32 has been described above, and therefore it will not be described in detail for conciseness. Please refer to FIG. 7 for a signal waveform chart of a gate line driving signal of an embodiment of the present invention. A driving signal of a third gate line 23 is logical high while a second output port 12 provides a trigger voltage to a third gate line 23 in a third period T3. In the meanwhile, since a third switch 33 receives the logical high signal which comes from the third gate line 23, the third switch 33 is turned on and one terminal of a fourth gate line 24 is electrically connected to an operating voltage Vdd. At the same time, since a third output port 13 only provides a logical low signal to a fifth gate line 25, a fourth switch 34 is turned off. Therefore, the driving signals of the third gate line 23 and the fourth gate line 24 are both logical high in the third period T3. And then, the second output port 12 provides a logical low signal to the third gate line 23 and further turns off the third switch 33 in a fourth period T4. Since the fourth switch 34 is still turned off, the driving signal of the fourth gate line 24 is still logical high in the fourth period T4. At last, when the third output port 13 provides a trigger voltage to the fifth gate line 25 in a fifth period T5, the driving signal of the fifth gate line 25 is logical high. In the meanwhile, since the fourth switch 34 receives the logical high signal from the fifth gate line 25, the fourth switch 34 is turned on and then makes one terminal of the fourth gate line 24 electrically connected to the ground point. By this means, the embodiment utilizes the third switch 33 and the fourth switch 34 to ensure the driving signal of the fourth gate line 24 to be logical high in the fourth period T4 and further to be logical low in the fifth period T5.

As mentioned above, the drawback of the embodiment is that when pixels corresponding to the first gate line 21 and the third gate line 23 might be coupled with the signals from the data lines for refreshing, the signals will incorrectly refresh pixels corresponding to the second gate line 22 in the first period T1 and incorrectly refresh pixels corresponding to the fourth gate line 24 in the third period T3. These incorrectly refreshed pixels will not be corrected until the second period T2 and the fourth period T4 respectively. However, since the refreshing rate is very high, this drawback almost cannot be observed by the naked eyes and therefore may be ignored. In conclusion, the gate line driving circuit of the LCD panel of the embodiment only uses three output ports to drive five gate lines. In other words, the embodiment only needs half of the driving chips to achieve the same effect in comparison with the prior art.

Figure 8:
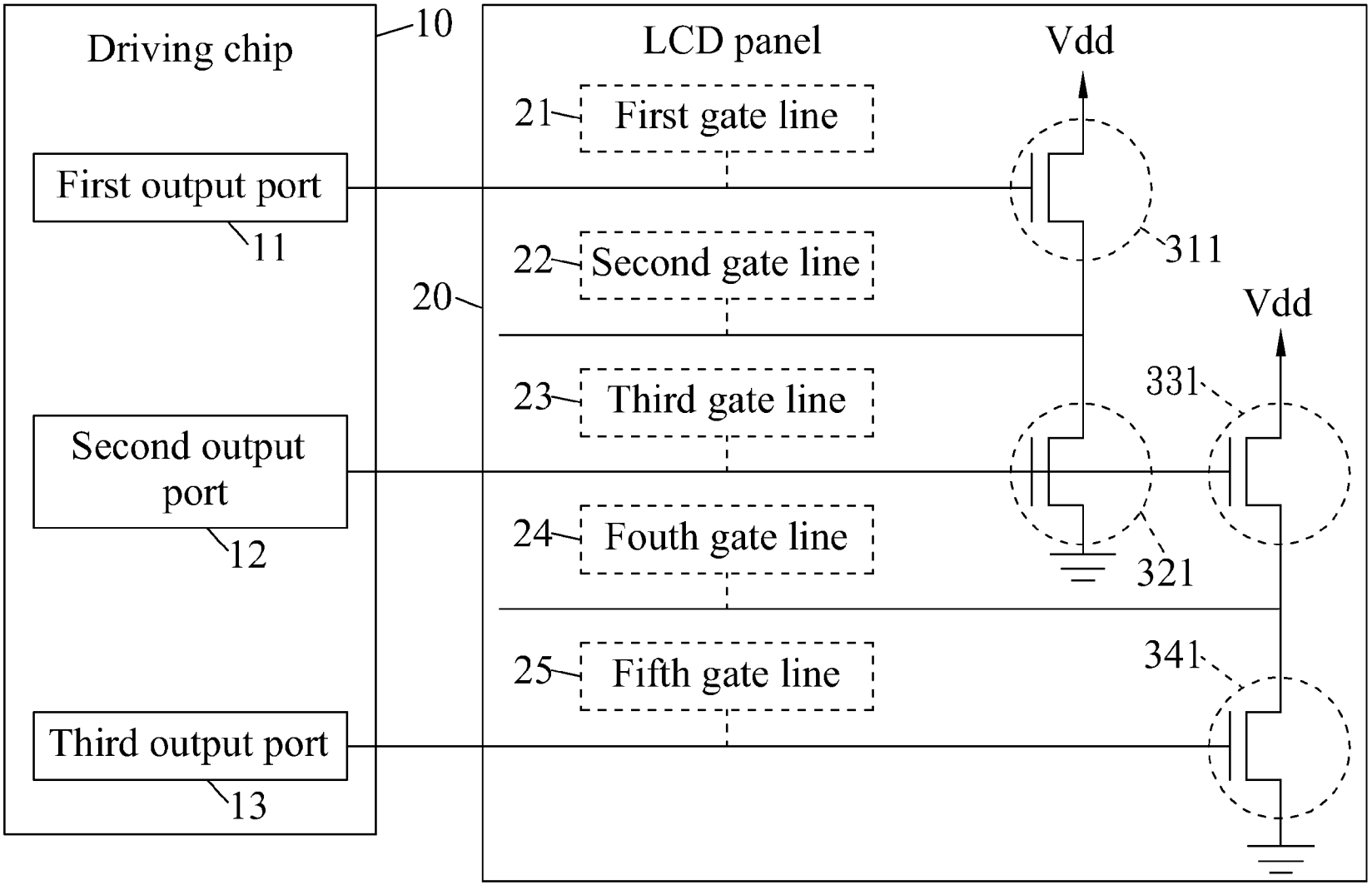
FIG. 8 is a schematic view of a gate line driving circuit of another embodiment of the present invention.

Refer to FIG. 8 for a schematic view of a gate line driving circuit of another embodiment in accordance with the present invention. A first switch 311, second switch 321, third switch 331 and fourth switch 341 are preferably transistor switches. Wherein, the first switch 321 and the second switch 331 are able to be driven by the same conductive line.

Figure 9:
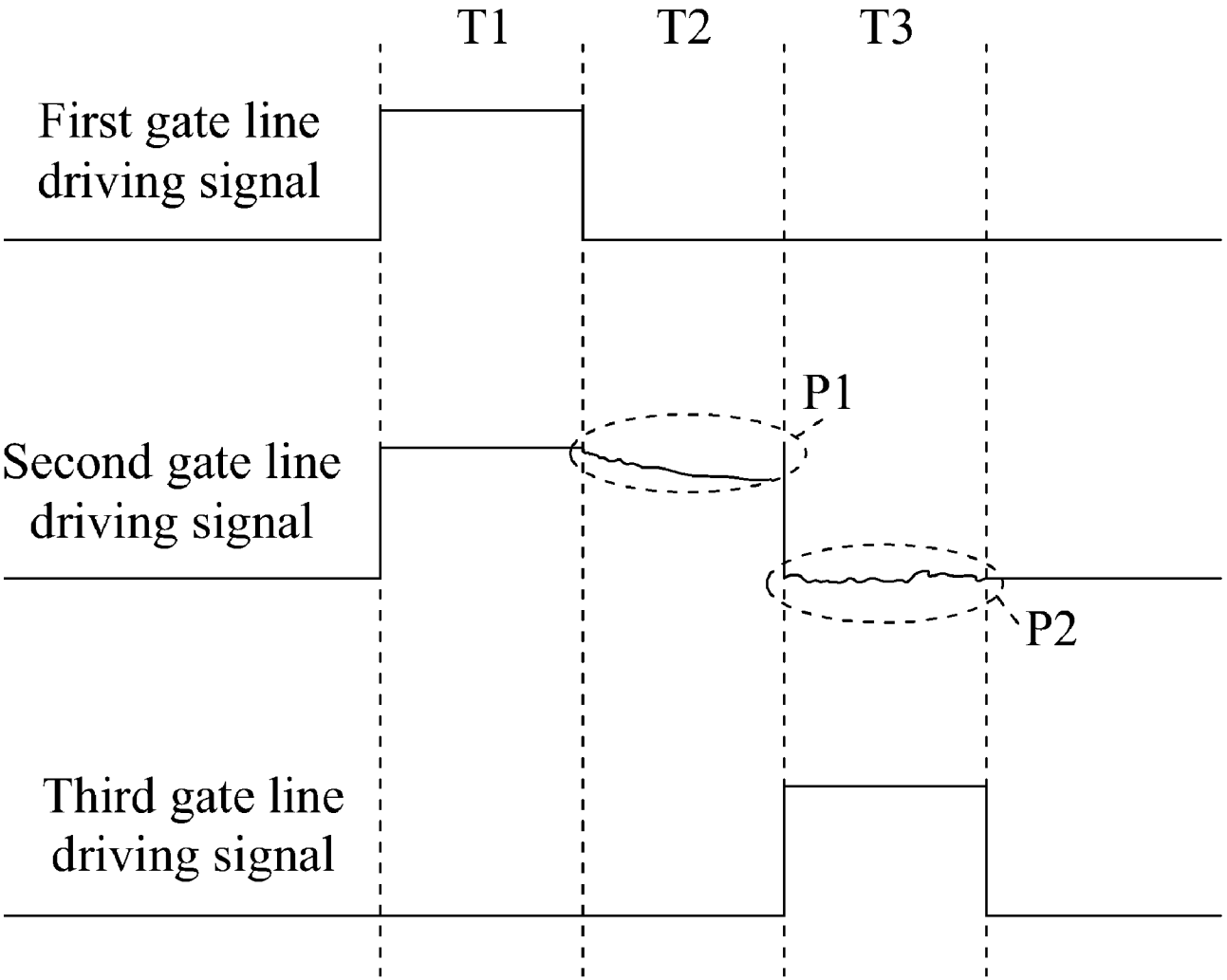
FIG. 9 is a signal waveform chart of a gate line driving signal of another embodiment of the present invention.

Refer to FIG. 9 for a signal waveform chart of a gate line driving signal of another embodiment in accordance with the present invention. A driving signal of a second gate line 22 is isolated from an operating voltage Vdd and a ground point via a first switch 31 and a second switch 32 in a second period T2. Therefore, the driving signal of the second gate line 22 may be an unstable logical high voltage in the second period T2, as shown in a first unstable period P1. Besides, although the driving signal of the second gate line 22 is electrically connected to the ground point via the second switch 32 in a third period T3, the driving signal of the second gate line 22 still may be floating due to an electromagnetic interference, as shown in a second unstable period P2. Therefore, the present invention further provides several embodiments as following to solve the problem mentioned above.

Figure 10:
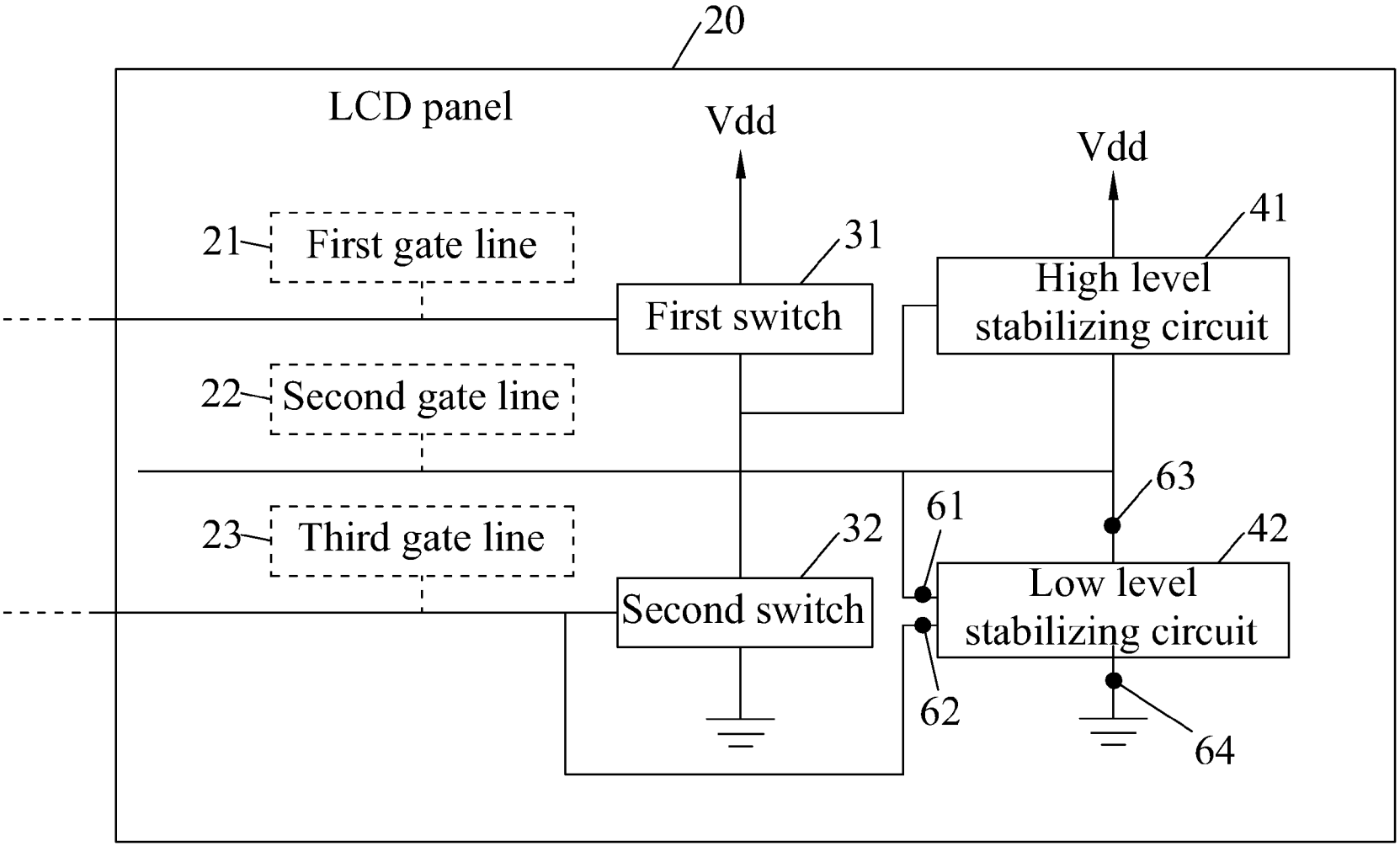
FIG. 10 is a schematic view of a gate line driving circuit and a level stabilizing circuit of an embodiment of the present invention.

Refer to FIG. 10 for a schematic view of a gate line driving circuit and a level stabilizing circuit of an embodiment in accordance with the present invention. The embodiment further provides a high level stabilizing circuit 41 and a low level stabilizing circuit 42 to solve the signal floating problem described in the first unstable period P1 and the second unstable period P2. For explaining the embodiment easily, the driving chip and output ports are omitted in the figure. Wherein, the high level stabilizing circuit 41 can be realized simply by a TFT. The control terminal of the TFT is electrically connected to the output terminal of a first switch 31. The input terminal of the TFT is electrically connected to an operating voltage Vdd. The output terminal of the TFT is electrically connected to a second gate line 22. By this means, when a driving signal of a first gate line 21 is logical low in a second period T2 and further causes the first switch 31 to be turned off, the driving signal of the second gate line 22 is still logical high and further triggers the high level stabilizing circuit 41. The high level stabilizing circuit 41 makes the second gate line 22 to be electrically connected to the operating voltage Vdd, and further keeps the driving signal of the second gate line 22 to be logical high in the second period T2.

Likewise, the low level stabilizing circuit 42 is preferably a TFT logical switch. The input terminal 63 of the TFT logical switch is electrically connected to the second gate line 22, and the output terminal 64 of the TFT logical switch is electrically connected to a ground point. A first control terminal 61 of the TFT logical switch is electrically connected to the second gate line 22, and a second control terminal 62 of the TFT logical switch is electrically connected to a third gate line 23. Therefore, when the driving signal of the second gate line 22 is logical low and the driving signal of the third gate line 23 is logical high in a third period T3, the input terminal 63 of the TFT logical switch electrically conducts the output terminal 64 of the TFT logical switch. In other words, the low level stabilizing circuit 42 makes the second gate line 22 electrically connect the ground point for eliminating a second unstable period P2.

Figure 11:
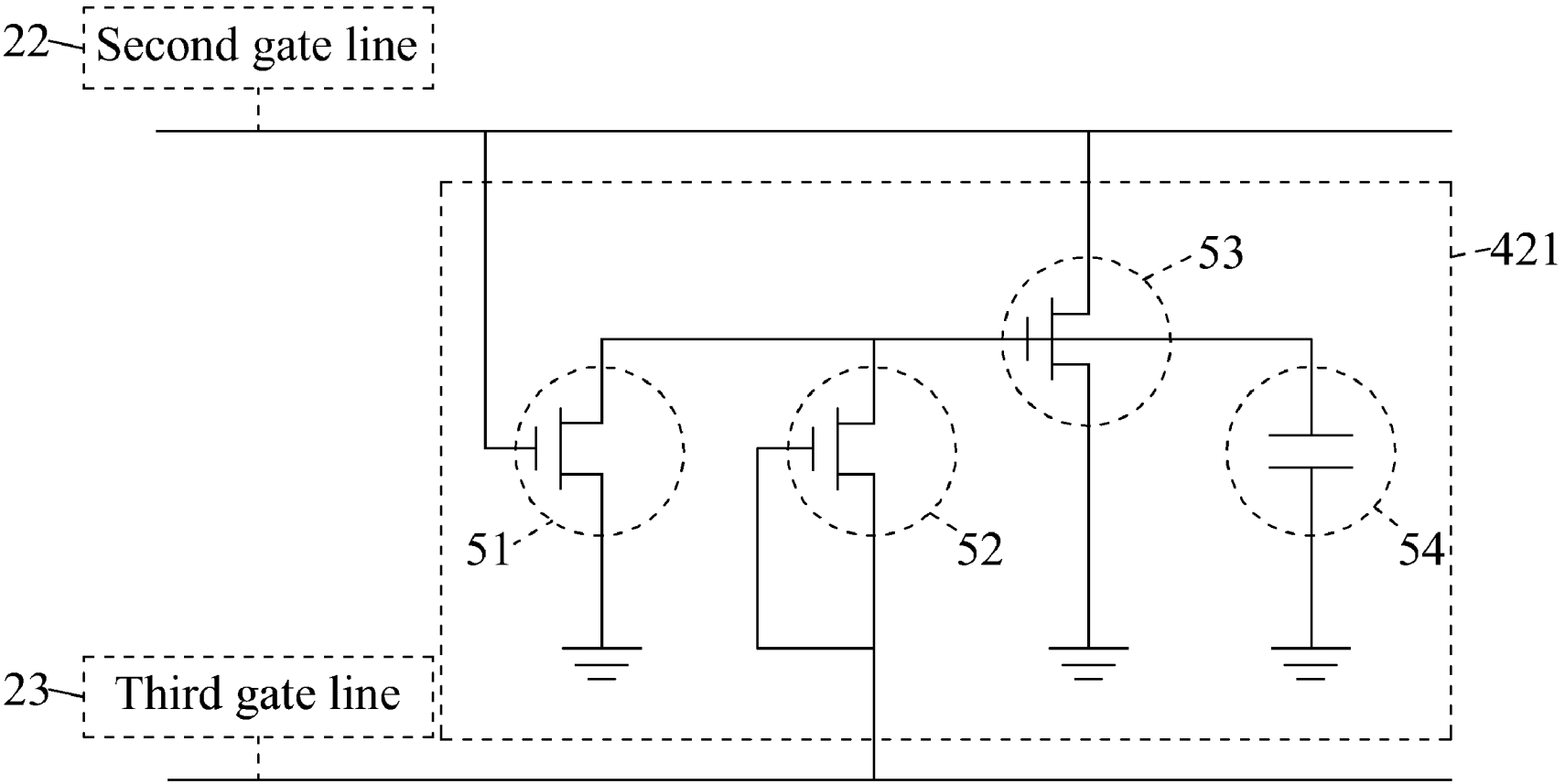
FIG. 11 is a schematic view of a low level stabilizing circuit of an embodiment of the present invention.

In addition, for realizing the TFT logical switch, a schematic view of a low level stabilizing circuit of an embodiment in accordance with the present invention is shown in FIG. 11. For describing the TFT logical switch easily, FIG. 11 simply shows a second gate line 22, a third gate line 23 and a low level stabilizing circuit 421. Wherein, the low level stabilizing circuit 421 comprises a transistor 51, a transistor 52, a transistor 53 and a capacitor 54. The connection relation has been described in FIG. 11, and will not further be described in detail here. The function of the low level stabilizing circuit 421 is described as the following. In a second period T2, the driving signal of the second gate line 22 is logical high and the driving signal of the third gate line 23 is logical low. In the meanwhile, the transistor 51 is turned on by the second gate line 22 and the transistor 52 is turned off by the third gate line 23. Therefore, the transistor 53 is turned off and the driving signal of the second gate line 22 is remained in the logical high level and will not be affected by the low level stabilizing circuit 421 in the second period T2. When it comes to a third period T3, the driving signal of the second gate line 22 is logical low and the driving signal of the third gate line 23 is logical high. In the meanwhile, the transistor 51 is turned off by the second gate line 22 and the transistor 52 is turned on by the third gate line 23. Therefore, the third gate line 23 feeds a high level voltage to the gate terminal of the transistor 53, and the transistor 53 is turned on. By this means, the second gate line 22 is electrically connected to a ground point via the transistor 53. Therefore, the voltage level floating problem in a second unstable period P2 is solved. Of course, people with ordinary skills in the art may be able to establish the low level stabilizing circuit 421 by the same philosophy in accordance with the present invention but using other structures.

Figure 12:
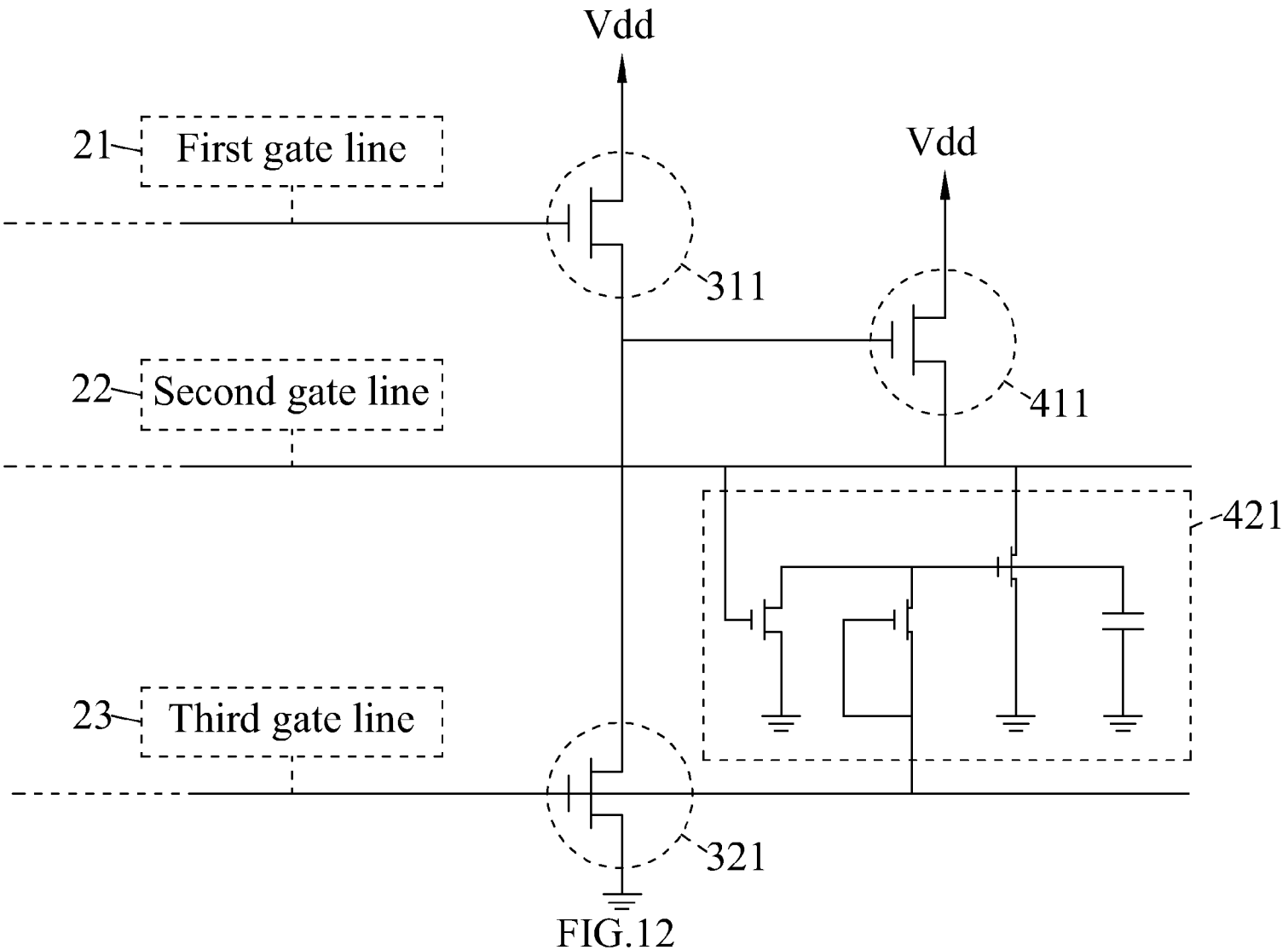
FIG. 12 is a schematic view of the high level stabilizing circuit of an embodiment of the present invention.
Figure 13:
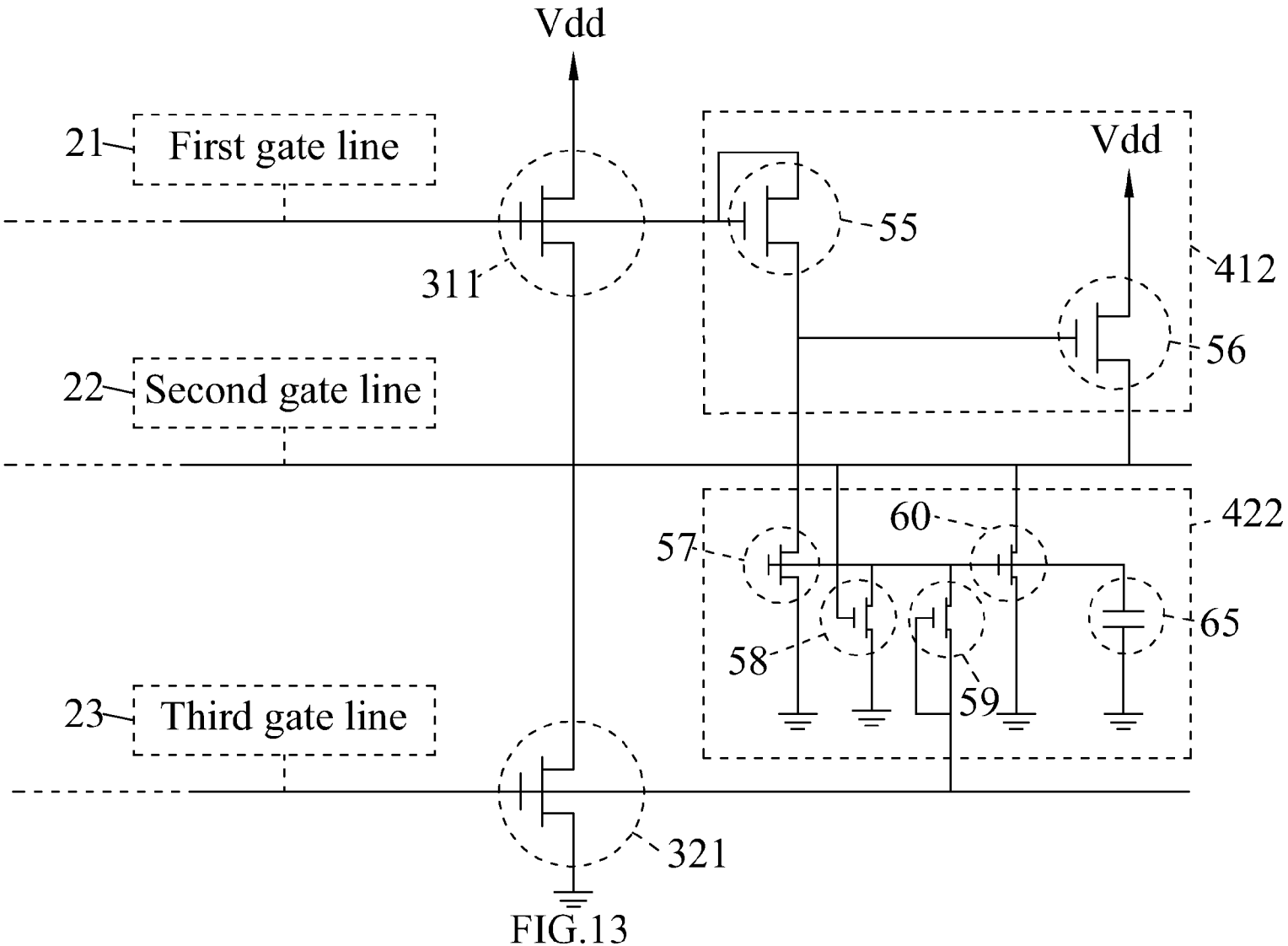
FIG. 13 is a schematic view of a level stabilizing circuit of an embodiment of the present invention.

Further, a schematic view of a high level stabilizing circuit of an embodiment of the present invention is disclosed in FIG. 12 for ensuring a high level stabilizing circuit 411 will not antagonize a low level stabilizing circuit 421. In FIG. 12, the connection relation and functions of each part have been described above, and will not be described again. The following is the operation status of the circuit. In a first period T1, a driving signal of a first gate line 21 is logical high and causes a transistor switch 311 to be turned on. A driving signal of a third gate line 23 is logical low and causes a transistor switch 321 to be turned off. In the meanwhile, the high level stabilizing circuit 411 is turned on, but the low level stabilizing circuit 421 is turned off. In the a second period T2, the driving signals of the first gate line 21 and the third gate line 23 are both logical low, and cause the transistor switch 311 and the transistor switch 321 to be turned off. However, since the driving signal of the second gate line 22 is still logical high, the high level stabilizing circuit 411 is turned on. In the a third period T3, the transistor switch 321 is turned on, and so as to pulls down the voltage level of the second gate line 22. The high level stabilizing circuit 411 is turned off since the gate terminal driving voltage is not high enough. Therefore, the high level stabilizing circuit 411 is turned off, but the low level stabilizing circuit 421 is turned on. Finally, please refer to FIG. 13 for a schematic view of the level stabilizing circuit of one an embodiment in accordance with the present invention. The level stabilizing circuit comprises a high level stabilizing circuit 412 and a low level stabilizing circuit 422. The high level stabilizing circuit 412 comprises a transistor 55 and a transistor 56. The low level stabilizing circuit 422 comprises a transistor 57, a transistor 58, a transistor 59, a transistor 60 and a capacitor 65. Wherein, the input terminal and control terminal of the transistor 55 are both electrically connected to a first gate line 21. The output terminal of the transistor 55 is electrically connected to the input terminal of the transistor 57, the control terminal of the transistor 56 and a second gate line 22. The input terminal of the transistor 56 is electrically connected to the operating voltage Vdd. The output terminal of the transistor 56 is electrically connected to the second gate line 22. The transistor 57, the transistor 58 and the transistor 60 are electrically connected to a ground point via their output terminals. One terminal of the capacitor 65 is electrically connected to the control terminals of the transistor 57 and the transistor 60, the input terminal of the transistor 58 and the output terminal of the transistor 59. The other terminal of the capacitor 65 is electrically connected to the ground point. The input terminals of the transistor 57 and the transistor 60 are electrically connected to the second gate line 22. The control terminal and the input terminal of the transistor 59 are electrically connected to a third gate line 23.

As mentioned above, the following is the description of the functions of the level stabilizing circuit. In a first period T1, the driving signal of the first gate line 21 is logical high and causes a transistor switch 311 to be turned on. The driving signal of the third gate line 23 is logical low and causes a transistor switch 321 to be turned off. In the meanwhile, the transistor 55 and the transistor 56 are both turned on and cause the driving signal of the second gate line 22 to be logical high. At the same time, the transistor 58 is turned on since the second gate line is in the high voltage level. The transistor 59 is turned off since the third gate line 23 is in the low voltage level. Therefore, the transistor 58 transfers the ground voltage to the control terminals of the transistor 57 and the transistor 60, and further turns off the transistor 57 and the transistor 60. In a second period T2, the first gate line 21 and the third gate line 23 are both in the low voltage level. However, the transistor 56 is turned on since the second gate line 22 is still at the high voltage level. And the driving signal of the second gate line 22 is stably logical high in the second period T2. In a third period T3, the third gate line 23 is at the high voltage level and causes the transistor 59 to be turned on. After the transistor 59 is turned on, the transistor 57 and the transistor 60 are also turned on. Wherein, the capacitor 65 is for stabilizing the high voltage level of the third gate line 23. At the same time, the transistor 57 and the transistor 60 pull down the voltage level of the second gate line 22, and cause trigger voltage of the gate terminal of the transistor 56 to be not enough to turn on itself. In other words, the transistor 56 is turned off. Therefore, the high level stabilizing circuit 412 is turned off, and the low level stabilizing circuit 422 is turned on.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A gate line driving circuit, comprising:

a driving chip at least comprising a first output port and a second output port;

a liquid crystal panel at least comprising a first gate line, a second gate line and a third gate line;

a first switch; and a second switch;

wherein one terminal of the first gate line is electrically connected to the first output port, the other terminal of the first gate line is electrically connected to a control terminal of the first switch, one terminal of the third gate line is electrically connected to the second output port, the other terminal of the third gate line is electrically connected to a control terminal of the second switch, an input terminal of the first switch is electrically connected to an operating voltage, an output terminal of the first switch is electrically connected to an input terminal of the second switch, an output terminal of the second switch is electrically connected to a ground point, and one terminal of the second gate line is electrically connected between the output terminal of the first switch and the input terminal of the second switch.

2. The gate line driving circuit of claim 1, wherein the first switch is a thin-film transistor switch.

3. The gate line driving circuit of claim 1, wherein the second switch is a thin-film transistor switch.

4. The gate line driving circuit of claim 1, further comprising a high level stabilizing circuit for stabilizing a high voltage level signal of the second gate line.

5. The gate line driving circuit of claim 4, wherein the high level stabilizing circuit is a thin-film transistor switch, a control terminal of the thin-film transistor switch is electrically connected to the output terminal of the first switch, an input terminal of the thin-film transistor switch is electrically connected to the operating voltage, and an output terminal of the thin-film transistor switch is electrically connected to the second gate line.

6. The gate line driving circuit of claim 1, further comprising a low level stabilizing circuit for stabilizing a low voltage level signal of the second gate line.

7. The gate line driving circuit of claim 6, wherein the low level stabilizing circuit is a thin-film transistor logical switch, an input terminal of the thin-film transistor logical switch is electrically connected to the second gate line, an output terminal of the thin-film transistor logical switch is electrically connected to the ground point, and a control terminal of the thin-film transistor logical switch is electrically connected to the third gate line.

* * * * *